US010705457B1

(12) United States Patent
Nakai et al.

(10) Patent No.: US 10,705,457 B1
(45) Date of Patent: Jul. 7, 2020

(54) POWDER ACCOMMODATING DEVICE AND IMAGE FORMING APPARATUS

(71) Applicant: FUJI XEROX CO., LTD, Tokyo (JP)

(72) Inventors: Daisuke Nakai, Kanagawa (JP); Taiyou Uehara, Kanagawa (JP)

(73) Assignee: FUJI XEROX CO., LTD, Minato-ku, Tokyo (JP)

( * ) Notice: Subject to any disclaimer, the term of this patent is extended or adjusted under 35 U.S.C. 154(b) by 0 days.

(21) Appl. No.: 16/531,238

(22) Filed: Aug. 5, 2019

(30) Foreign Application Priority Data

Mar. 19, 2019 (JP) ..... 2019-051347

(51) Int. Cl.
*G03G 15/08* (2006.01)

(52) U.S. Cl.
CPC ..... *G03G 15/0889* (2013.01); *G03G 15/0806* (2013.01); *G03G 15/0891* (2013.01)

(58) Field of Classification Search
CPC ..... G03G 15/0889; G03G 15/0806; G03G 15/0891
See application file for complete search history.

(56) References Cited

U.S. PATENT DOCUMENTS 8,862,036 B2 * 10/2014 Maeshima ..... G03G 15/0872 222/DIG. 1
9,639,028 B2 * 5/2017 Horii ..... G03G 15/0872

FOREIGN PATENT DOCUMENTS

JP 2016-071381 A 5/2016

* cited by examiner

*Primary Examiner* — David M. Gray
*Assistant Examiner* — Michael A Harrison
(74) *Attorney, Agent, or Firm* — Sughrue Mion, PLLC

(57) ABSTRACT

A powder accommodating device includes: an accommodating portion that has an opening at one end, is installed horizontally to accommodate powder, and transports the powder toward the opening by rotation; a lid portion that has a cylindrical inner wall surface, covers the opening and is held in a non-rotational state; and an agitation portion including: a cylindrical portion that is disposed in the lid portion, communicates with the opening, and rotates integrally with the accommodating portion; and plural agitation rods that each have a rod shape protruding from the cylindrical portion in a rotation axis direction in a direction away from the cylindrical portion and circulate along the inner wall surface to agitate the powder in the hollow portion, wherein at least some of the plural agitation rods are connected to each other via a beam provided at a position out of the cylindrical portion.

14 Claims, 6 Drawing Sheets

POWDER ACCOMMODATING DEVICE AND IMAGE FORMING APPARATUS

CROSS-REFERENCE TO RELATED APPLICATIONS

This application is based on and claims priority under 35 USC 119 from Japanese Patent Application No. 2019-051347 filed Mar. 19, 2019.

BACKGROUND

(i) Technical Field

The present disclosure relates to a powder accommodating device and an image forming apparatus.

(ii) Related Art

In an image forming apparatus that forms an image by using a toner, a toner bottle accommodating the toner is replaceably mounted. In the image forming apparatus, the toner is supplied from the toner bottle, and an image is formed using the toner. Here, since inconvenience such as a decrease in image density may occur if a supply amount of the toner cannot catch up with a consumption amount of the toner consumed by image formation, it is necessary to keep the supply capacity of the toner from the toner bottle at a high level. In addition, when supplying the toner from the toner bottle, it is necessary to stabilize the supply amount for each operation.

Here, JP-A-2016-071381 discloses a powder accommodating device including plural agitation rods for transmitting a driving force from a coupling to a toner bottle and agitating the toner in an autorotation toner cartridge.

SUMMARY

Aspects of non-limiting embodiments of the present disclosure relate to providing a powder accommodating device with a structure including an accommodating portion which accommodates and rotates powder, a lid portion which closes an opening of the accommodating portion and is held in a non-rotational state, and a driving force receiving portion which is disposed in the lid portion, rotates integrally with the accommodating portion when receiving a driving force, and includes plural agitation rods to agitate the powder moved from the accommodating portion to the lid portion, in which the movement of the powder from the accommodating portion in the lid portion is smoother compared to a structure in which all of the plural agitation rods are connected via a beam on an accommodating portion side, and to an image forming apparatus including the powder accommodating device.

Aspects of certain non-limiting embodiments of the present disclosure address the features discussed above and/or other features not described above. However, aspects of the non-limiting embodiments are not required to address the above features, and aspects of the non-limiting embodiments of the present disclosure may not address features described above.

According to an aspect of the present disclosure, there is provided a powder accommodating device including: an accommodating portion that has an opening at one end, is installed horizontally to accommodate powder, and transports the powder toward the opening by rotation; a lid portion that has a cylindrical inner wall surface, is provided with an outlet port open downward for the powder, includes a hollow portion that is open facing the opening, covers the opening and is held in a non-rotational state; and an agitation portion including: a cylindrical portion that is disposed in the lid portion, communicates with the opening, and rotates integrally with the accommodating portion when receiving a driving force; and plural agitation rods that each have a rod shape protruding from the cylindrical portion in a rotation axis direction in a direction away from the accommodating portion and the cylindrical portion and circulate along the inner wall surface to agitate the powder in the hollow portion, wherein at least some agitation rods among the plural agitation rods are connected to each other via a beam provided at a position out of the cylindrical portion.

BRIEF DESCRIPTION OF THE DRAWINGS

Exemplary embodiments of the present invention will be described in detail based on the following figures, wherein.

DETAILED DESCRIPTION

Exemplary embodiments of the present disclosure will be described below.

Figure 1:
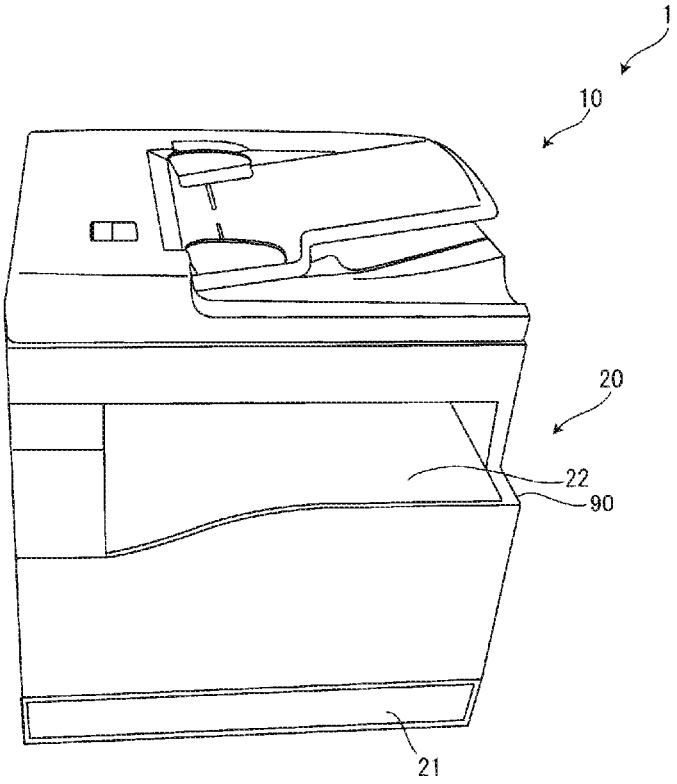
FIG. 1 is a perspective view of an appearance of an image forming apparatus according to an exemplary embodiment of the present disclosure.

FIG. 1 is a perspective view of an appearance of an image forming apparatus according to an exemplary embodiment of the present disclosure.

An image forming apparatus 1 includes a scanner 10 and a printer 20.

The scanner 10 is placed above an apparatus housing 90 which is a framework of the image forming apparatus 1, and the printer 20 is configured in the apparatus housing 90.

Figure 2:
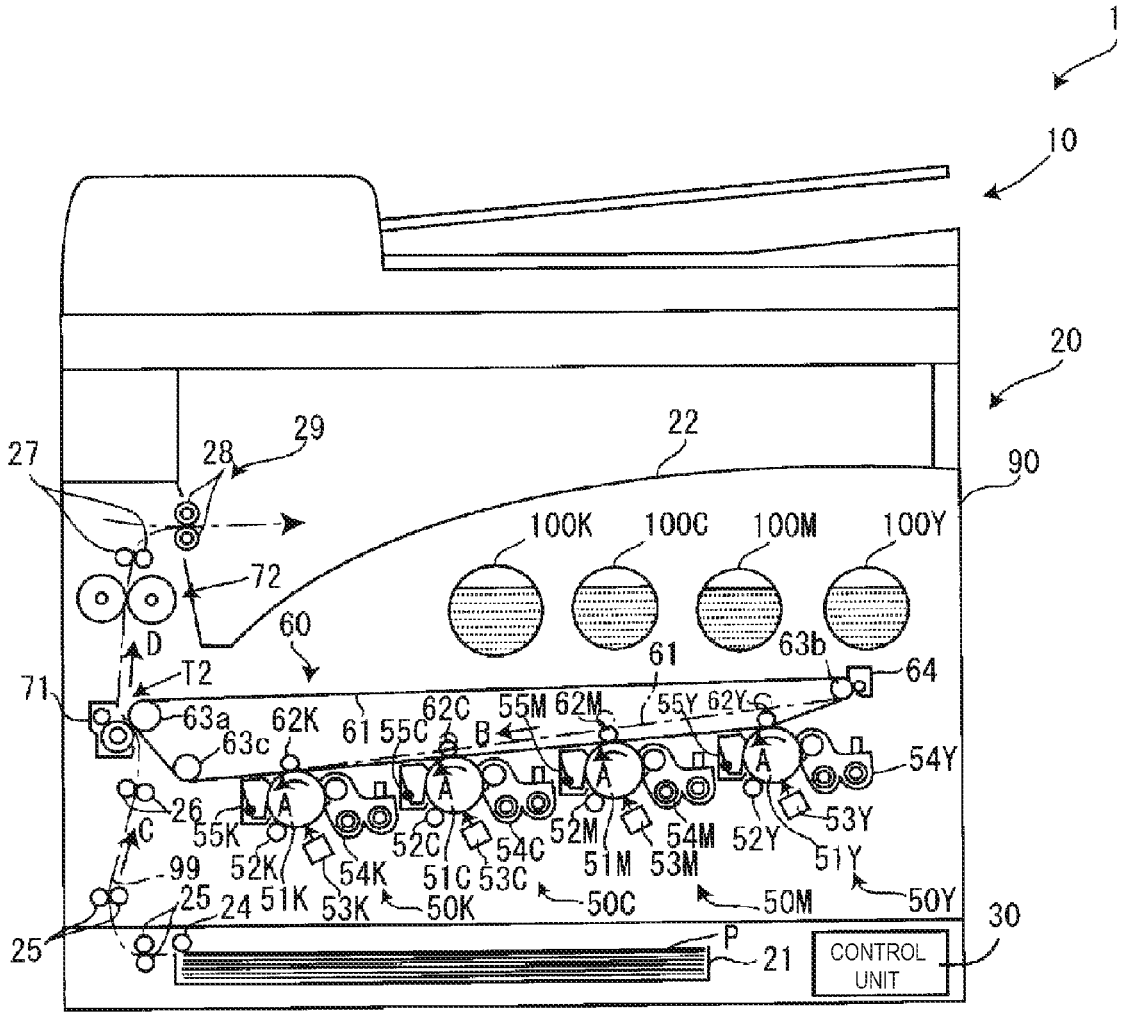
FIG. 2 is a schematic diagram showing an internal configuration of the image forming apparatus having an appearance shown in FIG. 1.

FIG. 2 is a schematic diagram showing an internal configuration of the image foil ring apparatus having an appearance shown in FIG. 1.

The printer 20 includes four image forming units 50Y 50M, 50C, and 50K arranged in a row substantially in a horizontal direction. In the image forming units 50Y, 50M, 50C, and 50K, toner images are formed by toners of respective colors of yellow (Y), magenta (M), cyan (C), and black (K). Here, regarding descriptions common to these image forming units 50Y, 50M, 50C, and 50K, reference signs of Y, M, C, and K, which represent the distinction of colors of the toners, are omitted and denoted as image forming unit 50. The same applies to other components other than the image forming unit.

Each of the image forming units 50 includes a photoconductor 51. The photoconductor 51 rotates in a direction of an arrow A when receiving a driving force, and at the same time, forms an electrostatic latent image on the surface thereof, and then a toner image is formed by development.

A charging unit 52, an exposure unit 53, a developing unit 54, a primary transfer unit 62, and a cleaner 55 are provided around each photoconductor 51 provided in each image forming unit 50. Here, the primary transfer unit 62 is placed at a position sandwiching an intermediate transfer belt 61 to be described later with the photoconductor 51. The primary transfer unit 62 is an element provided in an intermediate transfer unit 60 to be described later, not in the image forming unit 50.

The charging unit 52 uniformly charges the surface of the photoconductor 51.

The exposure unit 53 irradiates the uniformly charged photoconductor 51 with exposure light modulated based on an image signal to form an electrostatic latent image on the photoconductor 51.

The developing unit 54 develops the electrostatic latent image formed on the photoconductor 51 with a toner of a color corresponding to each image forming unit 50 to form a toner image on the photoconductor 51.

The primary transfer unit 62 transfers the toner image formed on the photoconductor 51 onto the intermediate transfer belt 61 to be described later.

The cleaner 55 removes the residual toner or the like on the photoconductor 51 after transfer from the photoconductor 51.

The intermediate transfer unit 60 is disposed above the four image forming units 50. The intermediate transfer unit 60 is provided with the intermediate transfer belt 6L The intermediate transfer belt 61 is supported by plural rollers such as a driving roller 63*a*, a driven roller 63*b*, and a tension roller 63*c*. The intermediate transfer belt 61 is driven by the driving roller 63*a* to circularly move in a direction of an arrow B along a circulation path including a path along the four photoconductors 51 provided in the four image forming units 50.

The toner images on respective photoconductors 51 are transferred so as to sequentially overlap on the intermediate transfer belt 61 by the action of the primary transfer unit 62. Then, the toner image transferred onto the intermediate transfer belt 61 is transported to a secondary transfer position T2 by the intermediate transfer belt 61. At the secondary transfer position T2, a secondary transfer unit 71 is provided, and the toner image on the intermediate transfer belt 61 is transferred onto paper P transported to the secondary transfer position T2 by the action of the secondary transfer unit 71. The transportation of the paper P will be described later. After the transfer of the toner image to the paper P, the toner or the like remaining on the intermediate transfer belt 61 is removed from the intermediate transfer belt 61 by a cleaner 64.

A toner cartridge 100 in which the toner of each color is accommodated is provided above the intermediate transfer unit 60. When the toner in the developing unit 54 is consumed due to the development, the toner cartridge 100 accommodating the toner of corresponding color rotates when receiving a driving force from a motor 40 (see FIG. 4), and the toner from the cartridge 100 is replenished to the developing unit 54 through a toner replenishing path (not shown). The toner cartridge 100 is configured to be attachable to and detachable from the apparatus housing 90, and is taken out when the toner is empty, and then a new toner cartridge 100 is mounted.

A piece of paper P is taken out from a paper tray 21 by a pickup roller 24, and transported to a timing adjustment roller 26 by a transport roller 25 in a direction of an arrow C along a transport path 99. The paper P transported to the timing adjustment roller 26 is fed toward the secondary transfer position by the timing adjustment roller 26 such that the paper P reaches the secondary transfer position T2 at a timing when the toner image on the intermediate transfer belt 61 reaches the secondary transfer position T2. The paper P fed by the timing adjustment roller 26 receives the transfer of the toner image from the intermediate transfer belt 61 at the secondary transfer position T2 by the action of the secondary transfer unit 71. The paper P, which has received the transfer of the toner image, is further transported in a direction of an arrow D and passes through a fixing unit 72. The toner image on the paper P is fixed onto the paper P after being heated and pressed by the fixing unit 72. Accordingly, an image formed of the fixed toner image is printed on the paper P. The paper onto which the toner image is fixed by the fixing unit 72 is further transported by a transport roller 27, and is fed from an ejection port 29 onto an ejection tray 22 by an ejection roller 28.

Further, the image forming apparatus 1 is provided with a control unit 30. The control unit 30 has an information processing function of executing a program, and is responsible for the overall control of the image forming apparatus 1 including the control of the rotation of the toner cartridge 100, which will be described later.

Next, the structure of the toner cartridge 100 will be described.

Figure 3:
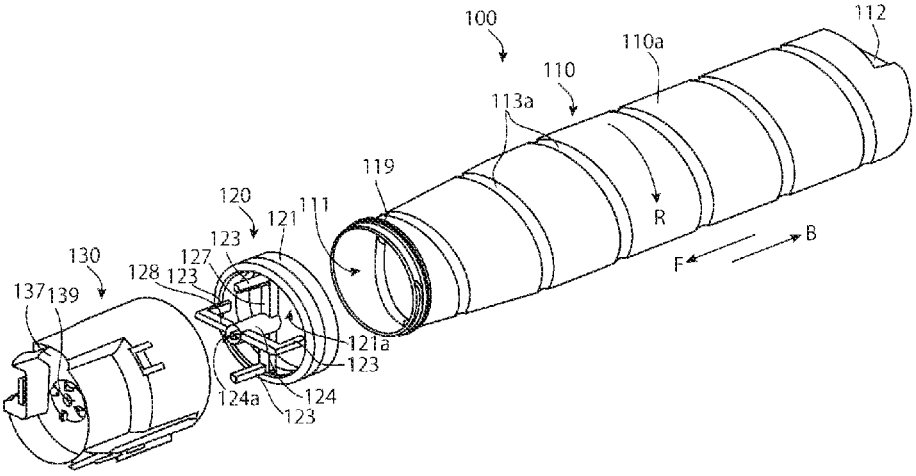
FIG. 3 is an exploded perspective view of a toner cartridge according to a first exemplary embodiment, which is adopted in the image forming apparatus shown in FIGS. 1 and 2.

FIG. 3 is an exploded perspective view of a toner cartridge according to a first exemplary embodiment, which is adopted in the image forming apparatus shown in FIGS. 1 and 2.

Figure 4:
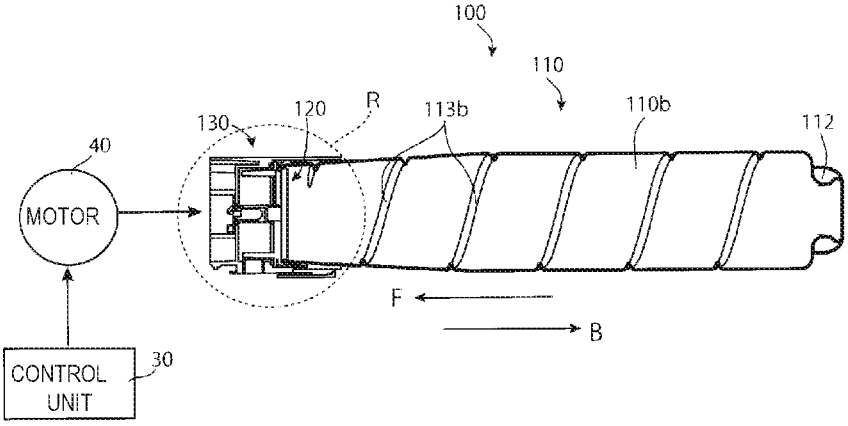
FIG. 4 is a longitudinal sectional view of the toner cartridge shown in FIG. 3.

FIG. 4 is a longitudinal sectional view of the toner cartridge shown in FIG. 3.

Figure 5:
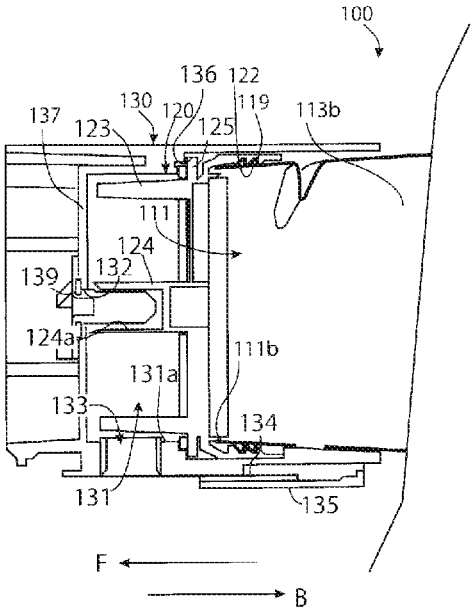
FIG. 5 is an enlarged view of a circle R shown in FIG. 4.

FIG. 5 is an enlarged view of a circle R shown in FIG. 4.

As shown in FIG. 3, the toner cartridge 100 includes a toner bottle 110, a fin 120, and a flange 130.

Here, the toner bottle 110 constituting the toner cartridge 100 corresponds to an example of an accommodating portion according to the present disclosure. In addition, the fin 120 corresponds to an example of an agitation portion according to the present disclosure. Further, the flange 130 corresponds to an example of a lid portion according to the present disclosure.

The toner cartridge 100 is assembled in a state shown in FIG. 4 with the toner accommodated in the toner bottle 110, and the toner cartridge 100 in the assembled state is accommodated in the image forming apparatus 1 shown in FIGS. 1 and 2 in a horizontal posture. In this accommodation, the toner cartridge 100 is inserted into the image forming apparatus 1 in a direction of an arrow F. Further, when the toner bottle 110 becomes empty, the toner cartridge 100 is pulled out in the direction of an arrow B, and a new toner cartridge 100 is inserted.

The toner bottle 110 has a substantially cylindrical shape, has an opening 111 at one end thereof, and accommodates the toner therein. In addition, the other end of the toner bottle 110 is provided with a handle 112 for grasping the toner cartridge 100 when the toner cartridge 100 is pulled out from the image forming apparatus 1. Further, a groove 113*a* extending spirally is formed on an outer peripheral surface 110*a* of the toner bottle 110. Although the spiral groove 113*a* is interrupted by a reinforcing rib, illustration of the reinforcing rib is omitted here.

As shown in FIG. 4, the back surface of the groove 113*a* protrudes to an inner peripheral surface 110*b* of the toner bottle 110. That is, on the inner peripheral surface 110*b* of the toner bottle 110, a ridge 113*b* extending in a spiral shape is formed. The toner bottle 110 rotates in a direction of an arrow R shown in FIG. 3, as will be described later. A toner (not shown) is filled in the toner bottle 110, and when the toner bottle 110 rotates, the toner is transported to the opening 111 side by the spiral-shaped ridge 113*b* on the inner peripheral surface 110*b* of the toner bottle 110.

A male screw 119 is formed on the outer peripheral surface 110*a* of the toner bottle 110 in the vicinity of the opening 111. A female screw 122 (see FIG. 5) of the fin 120 is screwed to the male screw 119, and thus the fin 120 is fixed to the toner bottle 110. Therefore, the toner bottle 110 and the fin 120 rotate integrally.

The fin 120 includes a cylindrical portion 121, and the female screw 122 is formed on an inner peripheral surface of the cylindrical portion 121. Further, plural (four in this example) paddles 123 are provided in the fin 120. These paddles 123 correspond to an example of an agitation rod according to the present disclosure.

Here, in the flange 130, a hollow portion 131 (see FIG. 5) open in a direction facing the toner bottle 110 is formed. The paddles 123 of the fin 120 are disposed inside the hollow portion 131 of the flange 130 and protrude in the direction of the arrow F. The paddles 123 agitate the toner, which is moved from the opening 111 of the toner bottle 110 to the inside the flange 130, by circulating the toner in a direction in which a rotation shaft rotates (direction of arrow R) and are responsible for preventing toner aggregation. Further, the paddles 123 also are responsible for scraping off the toner in the flange 130 into an outlet port 133 provided in the flange 130.

Further, at a position of a rotation center of the fin 120, a fitting protrusion 124 which protrudes in the direction of the arrow F and in which a fitting hole 124*a* is formed in the center is provided. The fitting protrusion 124 corresponds to an example of a driving force receiving portion according to the present disclosure. Meanwhile, a through hole 132 (see FIG. 5) is formed at a position of a wall 137 corresponding to a bottom plate of the hollow portion 131 of the flange 130 facing the fitting protrusion 124. A coupling 139 is inserted into the through hole 132 from the outer side (left side in FIG. 5) of the flange 130 and is fitted into the fitting hole 124*a*. When the toner cartridge 100 is inserted into the image forming apparatus 1 (see FIGS. 1 and 2), the coupling 139 is coupled to a coupling (not shown) on the apparatus main body side. Then, the coupling 139 is rotationally driven by the motor 40 provided in the apparatus main body via the coupling on the apparatus main body side. The coupling 139 is fitted into the fitting hole 124*a* of the fin 120, and when the coupling 139 rotates, the fin 120 also rotates integrally. Further, since the fin 120 is fixed to the toner bottle 110, when the fin 120 rotates, the toner bottle 110 also rotates integrally.

As shown in FIG. 5, the flange 130 has a locking groove 136 that runs round the circumferential and is formed on an inner wall surface 131*a* of the hollow portion 131. Meanwhile, the fin 120 has a locking protrusion 125 which is fitted into the locking groove 136. The fin 120 slides on the locking groove 136 in the rotation direction (the direction of the arrow R shown in FIG. 3), and the flange 130 is fixed to the fin 120 in the rotation axis direction (the left-right direction in FIG. 3). When the toner cartridge 100 is inserted into the image forming apparatus 1, the flange 130 is non-rotatably fixed to a cartridge mounting table 200. Therefore, the fin 120 is rotatable and slidable on the locking groove 136 of the flange 130.

The flange 130 serves as a lid for the toner bottle 110 and has the outlet port 133 from which the toner flows out. Further, the flange 130 is provided with a shutter 135 which opens and closes the outlet port 133 of the flange 130. The shutter 135 is open when the toner cartridge 100 is inserted into the image forming apparatus 1, and is closed when the toner cartridge 100 is pulled out. FIG. 5 shows the shutter 135 in an open state. When the shutter 135 is closed, the outlet port 133 is covered with a seal member 134 to prevent leakage of the toner. When the toner cartridge 100 is inserted into the image forming apparatus 1, the shutter 135 is open and the flange 130 is held in a non-rotational state. Further, the coupling on the apparatus main body side and the coupling 139 of the toner cartridge 100 are coupled. The coupling 139 is rotationally driven by the motor 40 controlled by the control unit 30 via the coupling on the apparatus main body side. Then, the fin 120 and the toner bottle 110 of the toner cartridge 100 are rotated by the rotational driving. The toner in the toner bottle 110 is transported to the opening 111 side by the rotation of the toner bottle 110, carried out from the opening 111, passes through the cylindrical portion 121 of the fin 120, and enters the hollow portion 131 of the flange 130. The toner entering into the hollow portion 131 of the flange 130 is scraped into the outlet port 133 by the paddles 123 while being agitated by the paddles 123 of the fin 120, then flows out from the outlet port 133 to the outside of the toner cartridge 100, and is replenished to the developing unit 54 through the toner replenishing path (not shown).

Note that, the toner cartridge 100 described here is representative of the toner cartridges 100Y, 100M, 100C, and 100K shown in FIG. 2. That is, the toner flowing out from the outlet port 133 of the toner cartridge 100 is supplied to the corresponding developing unit 54 and used to form a toner image.

As described above, the toner entering the hollow portion 131 of the flange 130 is scraped into the outlet port 133 by the paddles 123 while being agitated by the paddles 123 of the fin 120. Here, in the case of the example shown here, the fins 120 includes four paddles 123, and the four paddles 123 are formed at positions shifted in phase by 90° in the rotation direction. In this case, the toner cartridge 100 is intermittently driven to rotate by 90° at one time. In this way, when the toner cartridge 100 is intermittently driven to have a rotation angle same as the phase of the disposition of the paddles 123, the paddles 123 pass over the outlet port 133 only one time for each driving, and the amount of the toner delivered from the outlet port 133 by one driving is stabilized.

Here, a comparative example of the structure of the fin 120 will be described first, and then the structure of the fin 120 of the present exemplary embodiment will be described.

Figure 6A:
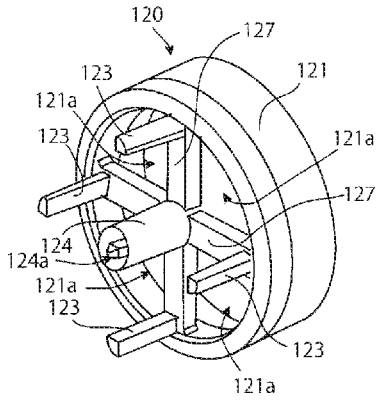
FIGS. 6A and 6B are perspective views of fins according to comparative examples.
Figure 6B:
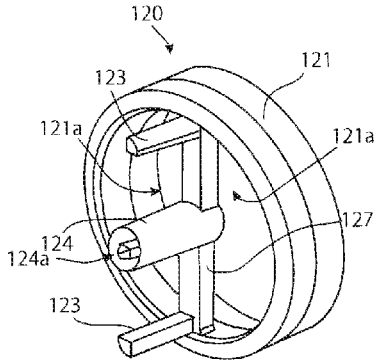

FIGS. 6A and 6B are perspective views of fins according to comparative examples. Here, two comparative examples are shown. Note that, in the description of the structure of the fin, the same reference numerals as those assigned to the fin in the exemplary embodiment are given to the comparative example, and description of the same elements as those already described with reference to FIGS. 3 to 5 is omitted.

In the case of the fin 120 shown in FIG. 6A, two paddles 123 at each diagonal are connected to each other via beams 127 on the inner side of the cylindrical portion 121. However, the beams 127 interpose the fitting protrusion 124 in the middle thereof to connect the two paddles 123 at each diagonal.

In the case of the fin of FIG. 6A, since the intermittent driving at 90° is adapted to the phase of the disposition of the paddles 123, the amount of the toner flowing out from the outlet port 133 (see FIG. 5) for each driving is stabilized.

However, since each opening 121*a* of the cylindrical portion 121 sandwiched between the two beams 127 in the vertical and horizontal directions is narrowed by the beams 127, the amount of the toner flowing toward the outlet port 133 side through the openings 121*a* is small, and the toner may not be supplied to the developing unit 54 in time.

Meanwhile, in the case of the fin 120 shown in FIG. 6B, only two paddles 123 are provided. The two paddles 123 are connected via the beam 127 on the inner side of the cylindrical portion 121 with the fitting protrusion 124 interposed therebetween.

In the case of the fin 120 shown in FIG. 6B, each opening 121*a* is widely open. Thus, the amount of the toner flowing toward the outlet port 133 through the openings 121*a* increases. However, the fin 120 shown in FIG. 6B is only provided with two paddles 123. Thus, the paddles 123 scrape off the toner into the outlet port 133 above the outlet port 133 (see FIG. 5) once for every two driving of the intermittent driving at 90°. Therefore, the amount of the toner supplied to the developing unit 54 varies greatly each time.

As described above, it is required to increase the amount of the toner passing through the fin 120 while stabilizing the amount of the toner passing through the fin 120 to move to the outlet port 133 side for each driving.

Therefore, in view of the above description of the comparative examples, the fin according to the present exemplary embodiment will be described.

Figure 7A:
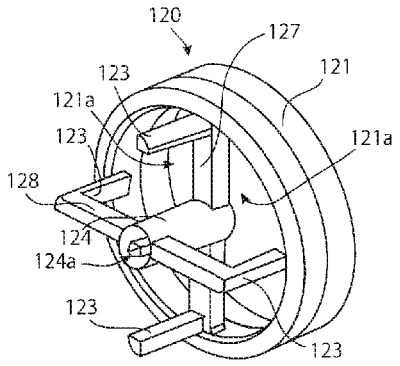
FIGS. 7A and 7B are perspective views of fins according to the exemplary embodiments.
Figure 7B:
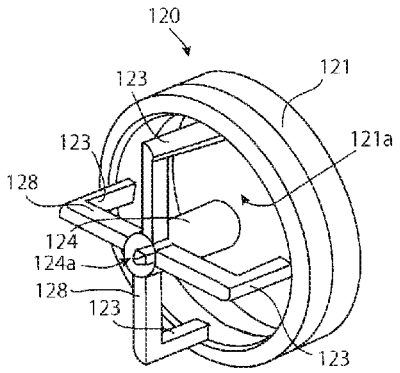

FIGS. 7A and 7B are perspective views of fins according to the exemplary embodiments. Here, FIG. 7A is a fin according to the first exemplary embodiment, which is also shown in FIG. 3. Further, FIG. 7B is a fin according to a second exemplary embodiment as a modification of the first exemplary embodiment. The above will be described in order below.

The fin 120 shown in FIG. 7A is provided with four paddles 123. Similarly to the paddles 123 in FIG. 6A, the two paddles 123 at one diagonal are connected to each other with the fitting protrusion 124 interposed in the middle of the beam 127 on the inner side of the cylindrical portion 121.

However, the remaining two paddles 123 are connected to each other via a beam 128 provided at a position out of the cylindrical portion 121 with the fitting protrusion 124 interposed therebetween. Specifically, in the first exemplary embodiment, the two paddles 123 are connected to each other via the beam 128 at a leading end portion out of the cylindrical portion 121 with the fitting protrusion 124 interposed therebetween.

In the first exemplary embodiment of FIG. 7A, each opening 121*a* in the cylindrical portion 121 is widened to the level same as the comparative example of FIG. 6B, and therefore, the amount of the toner passing through the cylindrical portion 121 toward the outlet port 133 aide increases to the level same as that in FIG. 6B.

In addition, in the case of the first exemplary embodiment shown in FIG. 7A, four paddles 123 are provided as in the comparative example of FIG. 6A. Thus, the paddles 123 pass over the outlet port 133 and scrape off the toner into the outlet port 133 every intermittent driving at 90°, and thereby the amount of the toner supplied to the developing unit 54 for each driving is stabilized.

In the case of the second exemplary embodiment shown in FIG. 7B, two pairs of paddles 123 each at one diagonal are connected to each other via the beam 128 at a leading end portion out of the cylindrical portion 121 with the fitting protrusion 124 interposed therebetween.

Therefore, in the case of the fin 120 of the second exemplary embodiment, the flow of the toner is smoother than that of the fin 120 in the first exemplary embodiment shown in FIG. 7A. However, in the case of the fin 120 of the second exemplary embodiment, since the cylindrical portion 121 is not supported via the beam 128 in the cylindrical portion 121, the cylindrical portion 121 may be more fragile compared to the fin 120 of the first exemplary embodiment shown in FIG. 7A. When the fragility can be compensated, for example, by using a material having strength, the structure of FIG. 7B is more advantageous because the flow of the toner is smooth.

The fins 120 of the exemplary embodiments shown in FIGS. 7A and 7B are each provided with four paddles 123. However, the number of the paddles 123 is not limited as long as at least two of the paddles 123 provided in the fin 120 are provided at positions out of the cylindrical portion 121. Specifically, the paddles 123 may be successively disposed at positions shifted by the same phase, and may be intermittently driven at an angle determined by the number of the paddles 123 at one time.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A powder accommodating device, comprising:

an accommodating portion that has an opening at one end, is installed horizontally to accommodate powder, and transports the powder toward the opening by rotation;

a lid portion that has a cylindrical inner wall surface, is provided with an outlet port open downward for the powder, includes a hollow portion that is open facing the opening, covers the opening and is held in a non-rotational state; and an agitation portion including: a cylindrical portion that is disposed in the lid portion, communicates with the opening, and rotates integrally with the accommodating portion when receiving a driving force; and a plurality of agitation rods that each have a rod shape protruding from the cylindrical portion in a rotation axis direction in a direction away from the accommodating portion and the cylindrical portion and circulate along the inner wall surface to agitate the powder in the hollow portion, wherein the agitation portion further comprises a driving force receiving portion that receives a rotational driving force and protrudes from the cylindrical portion in the same direction as the agitation rods at a position of a rotation center of the cylindrical portion, a first pair of agitation rods among the plurality of agitation rods are connected to each other via a first beam provided at a position out of the cylindrical portion with the driving force receiving portion interposed in the middle of the first beam, a leading end of each of the first pair of agitation rods is directly connected to the driving force receiving portion, and another portion of each of the first pair of agitation rods is directly connected to the cylindrical portion, and the first beam is the only direct connection between the first pair of agitation rods and the driving force receiving portion.

2. The powder accommodating device according to claim 1, wherein four agitation rods are provided in total at positions shifted in phase by 90 degrees in a circumferential direction, with two diagonal agitation rods among the four agitation rods forming a second pair of agitation rods and being connected via a second beam out of the cylindrical portion.

3. The powder accommodating device according to claim 1, wherein the plurality of agitation rods are disposed at positions shifted in phase by a predetermined angle in a circumferential direction, and the accommodating portion is intermittently rotated by the angle each time.

4. The powder accommodating device according to claim 3, wherein four agitation rods are disposed in total at positions shifted in phase by 90 degrees in the circumferential direction, and the accommodating portion intermittently rotates 90 degrees each time.

5. An image forming apparatus comprising the powder accommodating device according to claim 1, wherein the powder is supplied from the powder accommodating device to form an image.

6. The powder accommodating device according to claim 1, further comprising:

a second pair of agitation rods among the plurality of agitation rods, wherein the second pair of agitation are connected to each other via a second beam provided at a position out of the cylindrical portion with the driving force receiving portion interposed in the middle of the second beam, a leading end of each of the second pair of agitation rods is directly connected to the driving force receiving portion, and another portion of each of the second pair of agitation rods is directly connected to the cylindrical portion.

7. The powder accommodating device according to claim 6, wherein the second beam is the only direct connection between the second pair of agitation rods and the driving force receiving portion.

8. A powder accommodating device, comprising:

an accommodating portion that has an opening at one end, is installed horizontally to accommodate powder, and transports the powder toward the opening by rotation;

a lid portion that has a cylindrical inner wall surface, is provided with an outlet port open downward for the powder, includes a hollow portion that is open facing the opening, covers the opening and is held in a non-rotational state; and an agitation portion including: a cylindrical portion that is disposed in the lid portion, communicates with the opening, and rotates integrally with the accommodating portion when receiving a driving force; and a plurality of agitation rods that each have a rod shape protruding from the cylindrical portion in a rotation axis direction in a direction away from the accommodating portion and the cylindrical portion and circulate along the inner wall surface to agitate the powder in the hollow portion, wherein the agitation portion further comprises a driving force receiving portion that receives a rotational driving force and protrudes from the cylindrical portion in the same direction as the agitation rods at a position of a rotation center of the cylindrical portion, a first pair of agitation rods among the plurality of agitation rods are connected to each other via a first beam provided at a position out of the cylindrical portion with the driving force receiving portion interposed in the middle of the first beam, a second pair of agitation rods among the plurality of agitation rods are connected via a second beam inside the cylindrical portion, and the second pair of agitation rods are provided at positions shifted in phase by 90 degrees in a circumferential direction from the first pair of agitation rods.

9. The powder accommodating device according to claim 8, wherein the driving force receiving portion is interposed in the middle of the second beam.

10. The powder accommodating device according to claim 9, wherein the second beam is the only direct connection between the second pair of agitation rods and the driving force receiving portion.

11. The powder accommodating device according to claim 8, wherein the only connection between a leading end of each of the second pair of agitation rods and the agitation portion is the second beam.

12. The powder accommodating device according to claim 8, wherein a leading end of each of the first pair of agitation rods is directly connected to the driving force receiving portion, and another portion of each of the first pair of agitation rods is directly connected to the cylindrical portion, and the first beam is the only direct connection between the first pair of agitation rods and the driving force receiving portion.

13. The powder accommodating device according to claim 12, wherein a leading end of each of the second pair of agitation rods is directly connected to the driving force receiving portion, and another portion of each of the second pair of agitation rods is directly connected to the cylindrical portion, and the second beam is the only direct connection between the second pair of agitation rods and the driving force receiving portion.

14. The powder accommodating device according to claim 8, wherein a leading end of each of the second pair of agitation rods is directly connected to the driving force receiving portion, and another portion of each of the second pair of agitation rods is directly connected to the cylindrical portion, and the second beam is the only direct connection between the second pair of agitation rods and the driving force receiving portion.

* * * * *